US006860386B2

(12) United States Patent
Wolf

(10) Patent No.: US 6,860,386 B2
(45) Date of Patent: Mar. 1, 2005

(54) HIDDEN COMPARTMENT JEWELRY BOX

(75) Inventor: Simon Wolf, Malibu, CA (US)

(73) Assignee: Wolf Designs, Inc., Malibu, CA (US)

( * ) Notice: Subject to any disclaimer, the term of this patent is extended or adjusted under 35 U.S.C. 154(b) by 70 days.

(21) Appl. No.: 10/400,755

(22) Filed: Mar. 26, 2003

(65) Prior Publication Data

US 2004/0188275 A1 Sep. 30, 2004

(51) Int. Cl.[7] ..... A45C 11/04
(52) U.S. Cl. ..... 206/6.1
(58) Field of Search ..... 206/6.1, 557, 558, 206/566; 312/204; D3/275

(56) References Cited

U.S. PATENT DOCUMENTS

| | | | | |
|---|---|---|---|---|
| 2,564,122 A | | 8/1951 | Mele | |
| 2,738,250 A | | 3/1956 | Mele et al. | |
| D203,305 S | | 12/1965 | Ax | |
| 4,195,727 A | | 4/1980 | Mele | 206/45 |
| D270,980 S | | 10/1983 | Haigh | D6/172 |
| 4,662,519 A | * | 5/1987 | Ciociola | 206/457 |
| 4,925,255 A | * | 5/1990 | DeBlaay | 312/204 |
| 4,978,001 A | * | 12/1990 | Nelson | 206/748 |
| 5,127,719 A | | 7/1992 | Battista | 312/204 |
| 5,603,558 A | * | 2/1997 | Zimmer | 312/290 |
| 5,713,650 A | * | 2/1998 | King et al. | 312/265.4 |
| 5,823,328 A | | 10/1998 | Fomby | 206/8 |
| 6,045,202 A | * | 4/2000 | Simon | 312/107 |
| 6,059,388 A | | 5/2000 | Wheatley, Jr. | 312/246 |
| 6,158,578 A | * | 12/2000 | Greiner | 206/6.1 |
| 6,322,123 B1 | * | 11/2001 | Garrison et al. | 296/26.1 |
| D451,671 S | | 12/2001 | Wolf | D3/275 |
| D454,687 S | | 3/2002 | Wolf | D3/275 |
| D455,902 S | | 4/2002 | Wolf | D3/275 |

* cited by examiner

*Primary Examiner*—Kurt Fernstrom
(74) *Attorney, Agent, or Firm*—Cislo & Thomas LLP

(57) ABSTRACT

A jewelry box having one or more containers hidden in the interior thereof which are easily accessible and not easily discernable to an outside observer.

6 Claims, 5 Drawing Sheets

FIG. 5
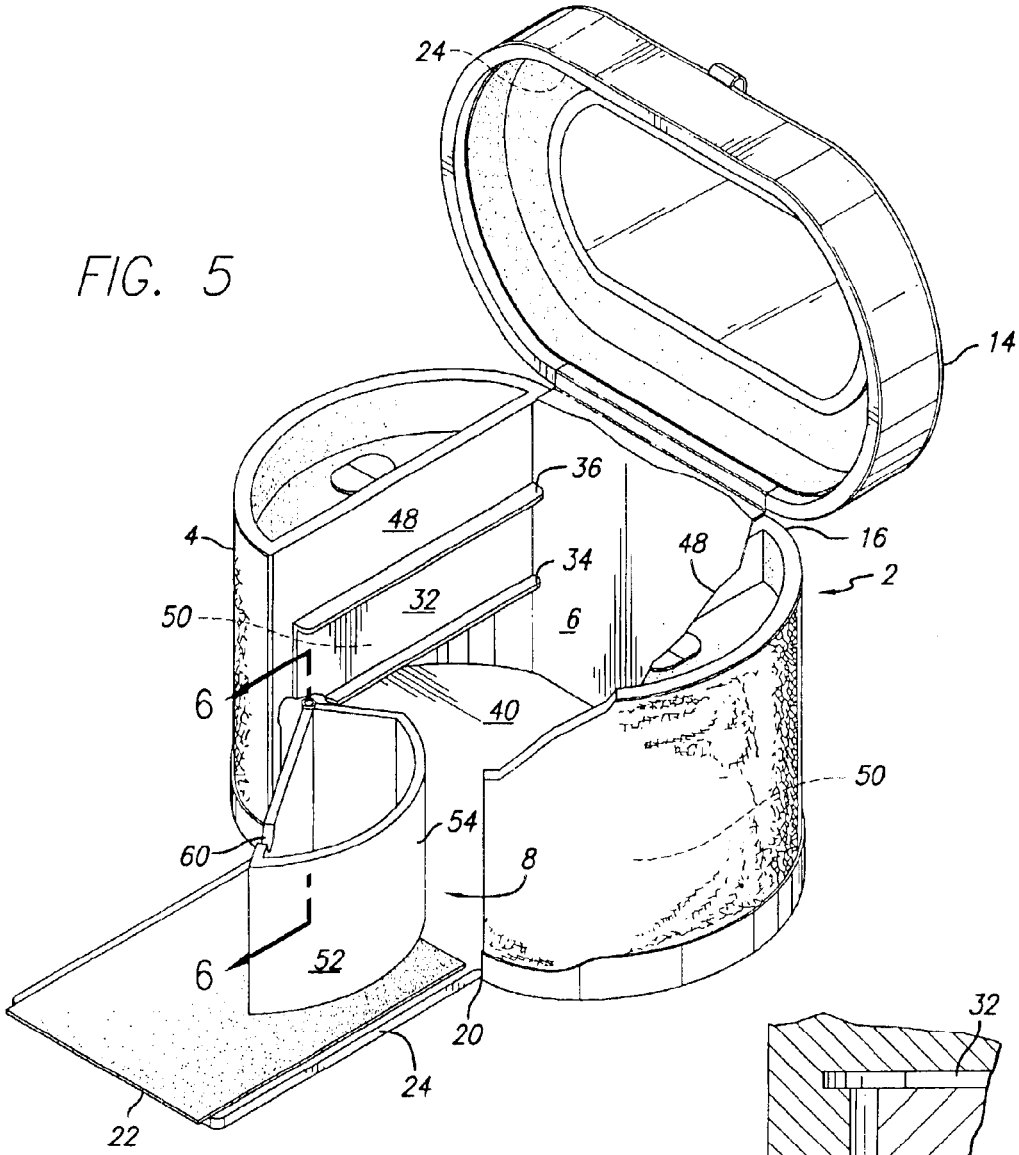
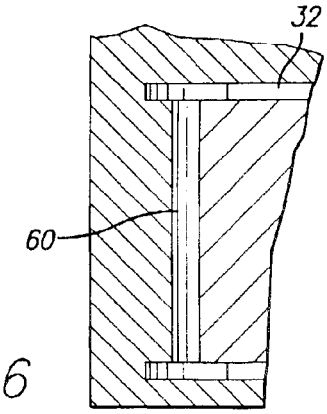
FIG. 6

HIDDEN COMPARTMENT JEWELRY BOX

COPYRIGHT AUTHORIZATION

A portion of the disclosure of this patent document contains material which is subject to copyright protection. The copyright owner has no objection to the facsimile reproduction by any one of the patent disclosure as it appears in the U.S. Patent and Trademark Office patent files or records, but otherwise reserves all copyright rights whatsoever.

BACKGROUND OF THE INVENTION

1. Field of the Invention

This invention relates to jewelry boxes and, more specifically, to jewelry boxes of the type that contain a hidden compartment or compartments therein which would be relatively easy to access, and yet to young children or a burglar it would not be known that there are hidden compartments within the jewelry box.

2. Description of the Related Art

Jewelry boxes of one type or another have been around for ages and have taken various forms but there has always been a need to have a jewelry box or the like that would have an area which would be imperceptible and wherein objects could be placed and be hidden from view so as not to be too easily or readily accessible to young children or those with larceny in their heart.

As far as is known there is no prior art that teaches a jewelry box that would have an open front to receive at least one slidably positionable drawer wherein the drawer would not fill the entire interior content or chamber of the jewelry box to thereby allow the positioning of one or more compartments within the interior of the jewelry box which would not be readily discernable to an outsider or young child, but yet would be readily accessible to the owner of the jewelry box.

In order for a hidden compartment or compartments to be located within a jewelry box and yet still be readily accessible, the hidden compartment of necessity must have at least some side walls that would be congruently configured to the compartment within which they are contained and wherein the other features of the jewelry box such as a drawer would be of lesser width in dimension than the overall width of the jewelry box so as to permit the positioning of a hidden compartment within the interior of the jewelry box and wherein the interiorly received container may be pivotally mounted for ease of positioning wholly within the container or rotatably or pivotally movable to an accessible location partially outside the interior of the jewelry box.

A search of related art has been conducted and no specific reference has been found that would detract from the overall patentability of the herein disclosed jewelry box having at least one hidden compartment which may or may not be pivotally mounted for positioning wholly within the interior of the jewelry box and then would be positionable partially exteriorly for ease of access.

U.S. Pat. Nos. 2,738,250 and 4,195,727 each disclose jewelry boxes having a pair of outwardly pivoting trays.

U.S. Pat. Nos. 2,564,122 and 5,823,328 each disclose storage boxes such as for jewelry having pivoting compartments.

U.S. Pat. No. 6,322,123 and more specifically the element 24 disclosed in FIGS. 2–5 inclusive, disclose a storage drawer having pivoting trays.

U.S. Pat. Nos. 5,127,719 and 6,059,388 each disclose jewelry boxes having concealment features, but none of the type as disclosed in the herein disclosed invention.

Similarly, U.S. Design Pat. Nos. 203,305, 270,980, 451, 671, 454,687 and 455,902 fail to disclose anything that would be remotely similar in over all concept with respect to hidden compartments to the instantly disclosed invention.

SUMMARY OF THE INVENTION

In its simplest form the invention is directed to a jewelry box for containing jewelry comprising the combination of a polygonal configured container defining an interior chamber and having a frontal opening of lesser dimension than the width of the container. The interior chamber of the jewelry box has a retaining means to slidably receive a removable drawer and a removable drawer is received within the interior chamber in operative association with the retaining means. The removable drawer is about the width of the frontal opening of the jewelry box and there is at least one smaller container adjacent the frontal opening and being movable to a first hidden position wholly within the interior chamber of the jewelry box, and a second non-hidden accessible position at least partially outside the interior of the jewelry box when the removable drawer is removed from the interior of the jewelry box to allow access to the smaller, previously hidden container.

OBJECTS OF THE INVENTION

It is an object of the present invention to provide a jewelry box having an interior chamber that can house at least one hidden container so that the same is not readily discernible from viewing the exterior of the jewelry box.

It is another more important specific object of the present invention to provide a jewelry box that has a specific configuration that allows for the placement of a hidden container within the jewelry box and which is easily accessible to the user thereof.

It is another still more important specific object of the invention to provide a jewelry box having a polygonal configuration and having a frontal opening with at least one removable drawer with at least one hidden container being positioned adjacent the frontal opening and wherein that container may be pivotally mounted so in one position it is wholly within the interior of the jewelry box and upon rotation is at least partially exterior of the interior of the jewelry box for ease of accessibility to the objects stored therein.

It is still another more important specific object of the invention to provide an ovoid configured jewelry box having a frontal opening wherein at least one removable drawer is retained therein and wherein there are hidden smaller containers, the side wall of each having the congruent configuration of the polygonal jewelry box and which upon removal of the removable drawer may be removable or rotatable to an accessible position to thereby allow ease of accessibility to articles contained therein.

It is still another more specific important object of the invention to provide a jewelry box having a frontal opening with a removable drawer and wherein there are two adjacently positioned hidden compartments or containers that are rotatable in and out of the interior of the jewelry box and wherein the jewelry box has an upper cover and a lower hinged front cover that may be located over the frontal opening and held in position by the top cover.

These and other objects and advantages of the present invention will be apparent from a review of the following specification and accompanying drawings.

BRIEF DESCRIPTION OF THE DRAWINGS

FIG. 5 is a cutaway view of the jewelry box shown in FIG. 4 showing more detailed construction as to how retaining means are provided to receive removable drawers and wherein more detailed construction is shown for a pivot support, where the same are used, for the hidden containers of the jewelry box of the invention and;

FIG. 6 is a view taken along 6—6 of FIG. 5.

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
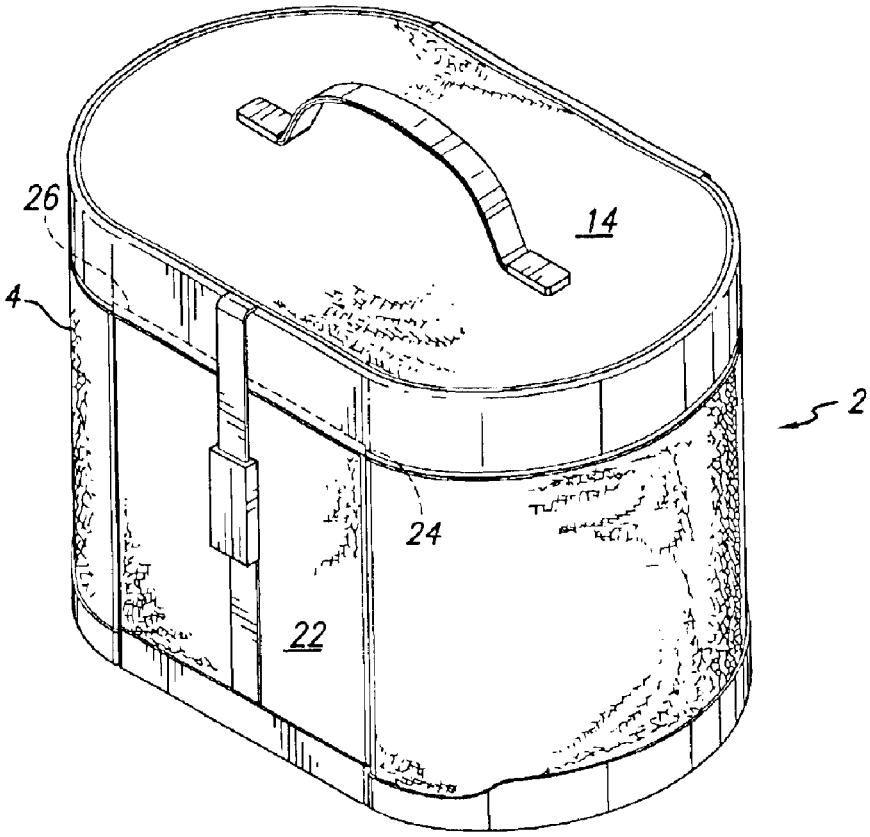
FIG. 1 is a front perspective view of the jewelry box of my invention shown in the closed position.

Referring to the drawings wherein like numerals of reference designate like elements throughout it will be seen that the jewelry box 2 here shown as being ovoid or polygonal in configuration, has an exterior wall 4 defining an interior chamber 6 and having a frontal opening 8 to receive drawers 10 and 12 for example in removable fashion with jewelry box 2 having an open top which is closable by reason of cover 14 being hingedly connected as at 16 so as to move from the open position shown in FIGS. 2, 3, 4 and 5 to the closed position as shown in FIG. 1.

Secured to the bottom wall 20 of jewelry box 2 is front cover plate 22 which is hingedly connected to bottom wall 20 by means of hinge member 24 such that upon upward rotation, frontal cover 22 is received in closing position and retained thereat by reason of the interior surface 24 of cover 14 holding the upper edge 26 of cover 22 as shown in FIG. 1.

Figure 2:
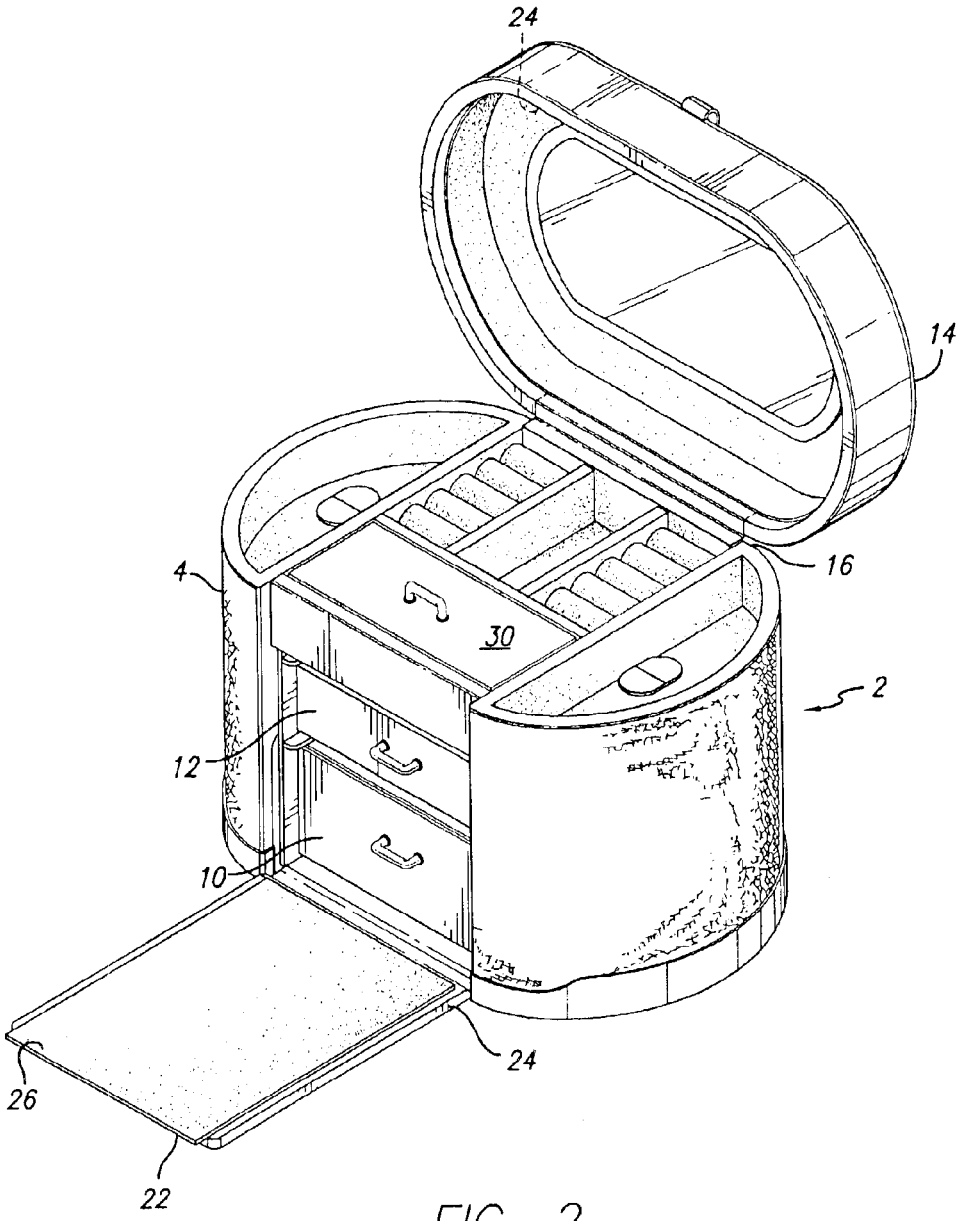
FIG. 2 is a front perspective view of the jewelry box of my invention shown with the top cover and the frontal cover being in the open position.

The interior 6 of jewelry box 2 defines a volume adapted to receive for example drawers 10 and 12 and even top container 30 as best seen in FIG. 2. The means to achieve support and slidable positioning of drawers 10 and 12 within the interior 6 of jewelry box 2 is achieved by reason of flanged bracket 32 providing guides or rails 34 and 36 upon which drawers 10 and 12, for example, may be releasably and slidably received in movable fashion and to that end those of ordinary skill in the art will recognize that the bottom wall 40 will form the support, for example, for bottom drawer 10 whereas the flanged bracket 32 positioned on either side of the interior 6 of jewelry box 2 will provide the mechanism for guiding and holding drawer 12 and container 30 within the interior chamber 6 of jewelry box 2. Those of ordinary skill in the art will recognize that the jewelry box 2 has two distanced and opposed vertical walls 48 for holding the flanged bracket or retaining means 32 by means of rivets or the like not shown.

Thus far the jewelry box 2 is of somewhat conventional construction but differs in that the frontal opening 8 is of lesser width than the overall width of the box 2 so that there is a void or empty space 50 within which may be placed one or more containers such as 52 to be totally hidden within the interior 6 of jewelry box 2 and, more specifically, within one or more of the voids 50.

While the containers 52 are shown as having at least one wall 54 congruently shaped to the interior of exterior wall 4 of jewelry box 2, other shapes may be utilized just so long as the overall desiratum is achieved: that is to have a hidden container within the jewelry box 2 in a space where one ordinarily would not think to look unless pre-knowledge was had.

Figure 4:
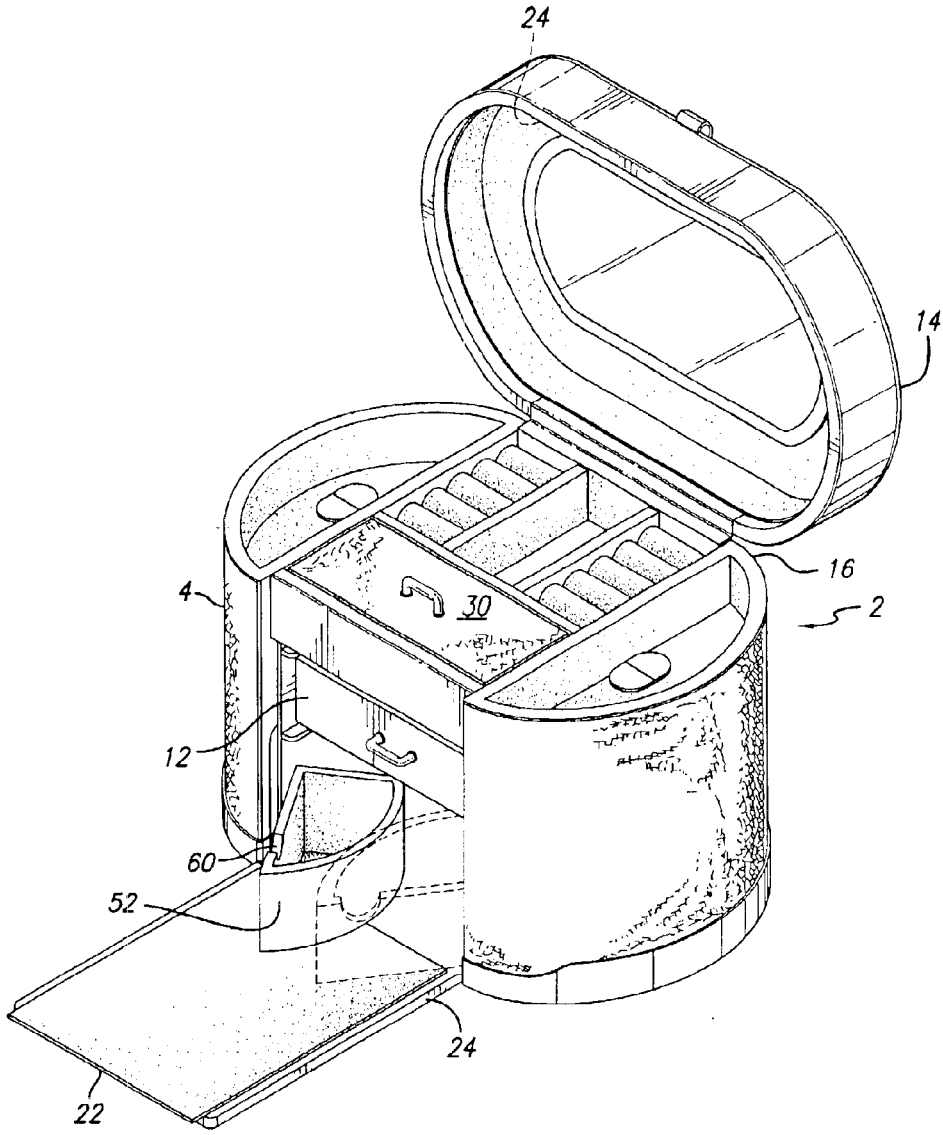
FIG. 4 is a view of the jewelry box of the invention similar to FIG. 3 but showing the bottom drawer removed and the hidden containers that are housed within the interior of the jewelry box.

The containers 52 shown in FIG. 4 are not connected to or pivotally mounted in any manner but are merely placed within the voids 50 manually and once in position the drawer 10, for example, may be placed therein such that the container or containers 52 (where one or more are desired) are completely hidden and obstructed from view.

However, in the preferred mode and referring to FIGS. 5 and 6 the containers 52 are pivotally mounted by means of a pivot post 60 secured to the flanged bracket 32 in conventional fashion or otherwise secured to the wall 48 such that the container 52 is pivotable from a first position wholly within the interior 6 of jewelry box 2 or to a second position that is partially outside the interior 6 for ease of accessibility to the interior of the container 52.

To aid in retrieving or rotating the container 52 from inside of the jewelry box 2 to the outside is shown in FIG. 5, a notch, for example 60 is placed in an upper edge so that the same may be easily grasped by the finger of the user.

Figure 3:
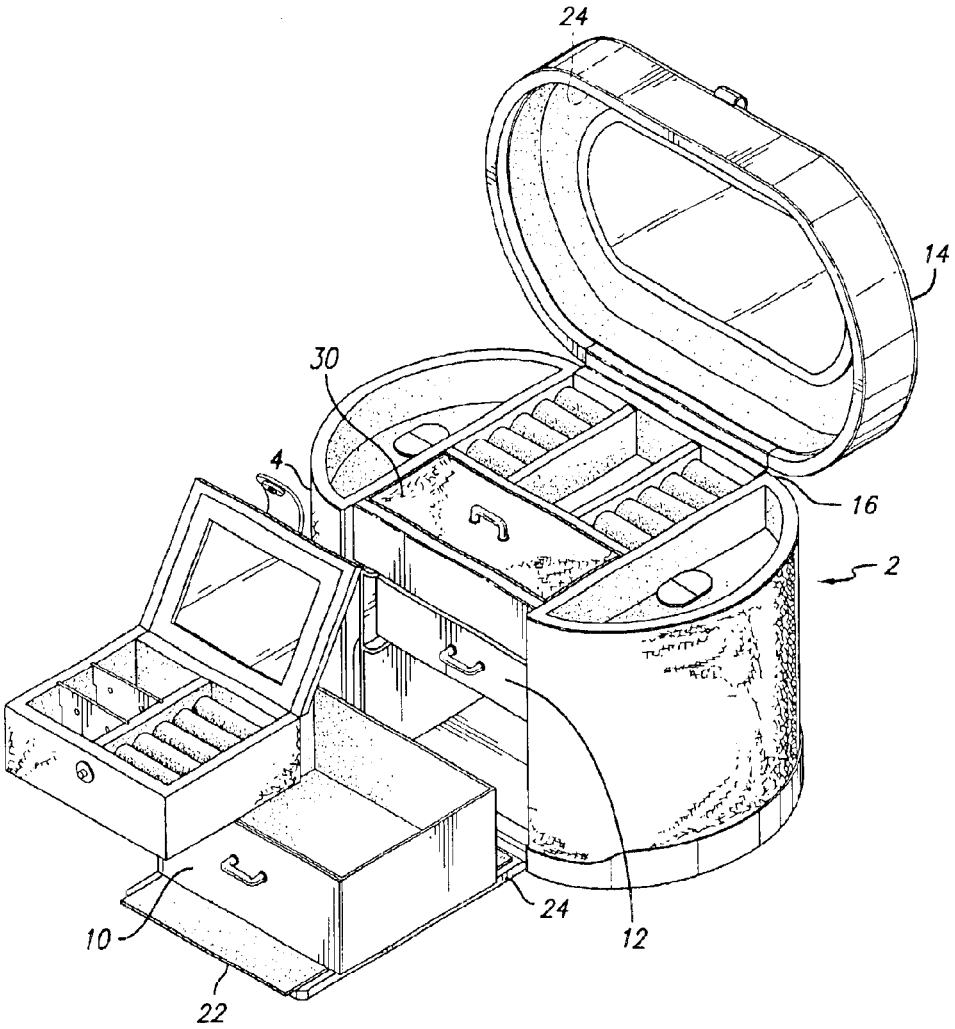
FIG. 3 is a view similar to FIG. 2 showing the removability of the bottom drawer of the jewelry box and wherein the bottom drawer is capable of housing a separate travel case.

The exterior of the jewelry box 2 may be of padded plastic, leather, metal or any commonly found and utilized materials of construction for jewelry boxes, it only being important that when the jewelry box is opened as for example in FIG. 2 and the bottom drawer removed as shown in FIG. 3, no one viewing the jewelry box 2 would have any pre-knowledge of the fact that there are one or more hidden compartments or containers within the interior chamber of the jewelry box 2. Where the hidden container or containers are pivotally mounted the same may be rotated outwardly in order to gain access to the interior thereof in which jewelry or the like may be housed.

Thus, there has been described a unique jewelry box which has the advantages of having hidden containers or compartments within the interior of the jewelry box which would not be generally discernable to children of tender years or those who would not know about the hidden compartments or containers and which are easily accessible to those having knowledge of the overall construction of the jewelry box.

The materials of construction, as indicated hereinbefore, may be any of those that are commonly used for jewelry boxes whether they be wood, plastic, lacquered or reinforced cardboard or the like held together by rods, screws, nails and/or glue, with various coverings depending on the choice of the designer.

While the present invention has been described with regards to a specific polygonal configuration, those of ordinary skill in the art will of course recognize that various shapes may be utilized, it only being important that the removable or positionable drawers or drawer take up less of the interior volume of the overall box so as to permit the placement of a hidden container or compartment within the remainder of the interior of the jewelry box. Various modifications and changes may be made all without deviating from the essence of the invention as those of ordinary skill in the art will recognize and all such deviations and modifications are intended to be covered by the appended claims.

What is claimed is:

1. A jewelry box for containing jewelry comprising the combination of:

a multi-sided container defining an interior chamber and having a frontal opening of lesser dimension than the width of said container;

said interior chamber having retaining means to slidably receive a slidable drawer;

a slidable drawer received within said interior chamber in operative association with said retaining means;

said slidable drawer being of about the width of said frontal opening; and at least one container adjacent said frontal opening and being movable to a first hidden position wholly within said interior chamber and a second accessible position once said slidable drawer is removed outwardly from said interior chamber, further wherein said slidable drawer is removable from said interior chamber and wherein said container is pivotally mounted adjacent said frontal opening and is movable from a first hidden position wholly within said interior chamber into a second unhidden accessible position with respect to said interior chamber and said jewelry box additionally includes a hinged cover and said container is open topped, said pivotally mounted containers are on either side of said frontal opening and rotate outwardly for ease of accessibility, each of said pivotally mounted containers have notches on an accessible edge wall thereof for ease of grasping.

2. The jewelry box in accordance with claim 1 wherein said multi-sided container is ovoid in shape.

3. The jewelry box in accordance with claim 2 wherein said slidable drawer is rectangular.

4. The jewelry box in accordance with claim 3 wherein the side wall of said pivotally mounted containers are congruently shaped to the exterior side wall of said multi-sided container.

5. The jewelry box in accordance with claim 4 which additionally includes a front cover hingedly secured to the bottom of said multi-sided container.

6. The jewelry box in accordance with claim 5 wherein said hinged cover is retained in covering position by reason of said hinged cover being superpositioned thereover.

* * * * *